US007832533B2

(12) United States Patent
Selvi

(10) Patent No.: US 7,832,533 B2
(45) Date of Patent: Nov. 16, 2010

(54) ARTICLE OF LUGGAGE

(75) Inventor: Sedat Selvi, London (GB)

(73) Assignee: Landor & Hawa International Limited, Essex (GB)

( * ) Notice: Subject to any disclaimer, the term of this patent is extended or adjusted under 35 U.S.C. 154(b) by 0 days.

(21) Appl. No.: 10/576,337

(22) PCT Filed: Oct. 20, 2004

(86) PCT No.: PCT/GB2004/004425

§ 371 (c)(1),
(2), (4) Date: Mar. 14, 2007

(87) PCT Pub. No.: WO2005/044039

PCT Pub. Date: May 19, 2005

(65) Prior Publication Data

US 2007/0209894 A1 Sep. 13, 2007

(30) Foreign Application Priority Data

Oct. 21, 2003 (GB) ..... 0324487.8
Jul. 9, 2004 (GB) ..... 0415404.3

(51) Int. Cl.
*A45C 13/00* (2006.01)

(52) U.S. Cl. ..... 190/124; 190/18 A; 190/103; 190/903

(58) Field of Classification Search ..... 190/124, 190/125, 126, 115, 18 A, 103
See application file for complete search history.

(56) References Cited

U.S. PATENT DOCUMENTS

D21,154 S 11/1891 Officer
1,616,632 A * 2/1927 Saviour ..... 280/79.2
1,751,936 A * 3/1930 Lowe ..... 206/8
2,912,080 A * 11/1959 Ikelheimer ..... 190/127
3,158,238 A 11/1964 Kish, Jr.
3,443,671 A * 5/1969 Dyke ..... 190/103
3,544,418 A * 12/1970 Holtzman ..... 428/162
3,606,372 A * 9/1971 Browning ..... 280/47.17
3,865,166 A 2/1975 Pedro
4,123,839 A 11/1978 Weiner
4,128,150 A 12/1978 Popkin et al.
4,287,971 A 9/1981 Doulet (Continued)

FOREIGN PATENT DOCUMENTS

CN 85105303 1/1987

(Continued)

*Primary Examiner*—Tri M Mai
(74) *Attorney, Agent, or Firm*—Caesar, Rivise, Bernstein, Cohen & Pokotilow, Ltd.

(57) ABSTRACT

A method of producing an article of luggage characterized by a "soft" case construction characterized by the steps of molding from a material exhibiting "soft" case characteristics lid forming and base forming sections of such construction as to be shape wise self supporting in the absence of a perimeter frame and side, base or back panels whereby the form of the case is established and maintained by the molded lid and base sections; and an article of luggage produced by the method and characterized by a "soft" case construction including lid and base forming sections of such construction as to be shape wise self supporting in the absence of a perimeter frame and side, base or back panels whereby the form of the case is established and maintained by the molded lid and base sections.

3 Claims, 5 Drawing Sheets

U.S. PATENT DOCUMENTS

| | | | | | |
|---|---|---|---|---|---|
| 4,610,334 | A | | 9/1986 | Pelavin | |
| 4,703,519 | A | * | 10/1987 | Krenzel | 383/97 |
| 4,773,515 | A | * | 9/1988 | Kotkins, Jr. | 190/103 |
| 5,004,091 | A | * | 4/1991 | Natho et al. | 190/18 R |
| 5,065,847 | A | | 11/1991 | Hsieh | |
| 5,111,919 | A | | 5/1992 | Hamatani et al. | |
| 5,228,546 | A | | 7/1993 | Chang et al. | |
| 5,252,161 | A | * | 10/1993 | Chang et al. | 156/196 |
| 5,284,542 | A | * | 2/1994 | Lee | 156/242 |
| 5,358,082 | A | | 10/1994 | Armstrong, IV | |
| 5,447,261 | A | * | 9/1995 | Mitomi et al. | 224/153 |
| 5,575,361 | A | | 11/1996 | Chou | |
| 5,671,831 | A | | 9/1997 | Chiu | |
| 5,881,932 | A | | 3/1999 | Wadden | |
| 6,003,646 | A | * | 12/1999 | Paudler | 190/124 |
| 6,059,078 | A | | 5/2000 | Nykoluk | |
| 6,062,356 | A | * | 5/2000 | Nykoluk | 190/18 R |
| 6,102,172 | A | * | 8/2000 | Dercole | 190/18 A |
| 6,220,411 | B1 | | 4/2001 | Scicluna et al. | |
| D443,136 | S | | 6/2001 | Fusi | |
| 6,305,513 | B1 | | 10/2001 | Lu | |
| 6,345,709 | B1 | | 2/2002 | Cheng | |
| 6,367,603 | B1 | | 4/2002 | Tiramani et al. | |
| 6,390,259 | B1 | * | 5/2002 | Lu | 190/103 |
| 6,408,997 | B1 | | 6/2002 | Chen | |
| 6,533,087 | B1 | | 3/2003 | Chen | |
| 6,575,272 | B1 | | 6/2003 | Krulik et al. | |
| 6,591,950 | B1 | | 7/2003 | Scicluna | |
| 6,595,354 | B1 | | 7/2003 | Scicluna | |
| 6,609,598 | B2 | | 8/2003 | Hsu | |
| D481,206 | S | | 10/2003 | Nykoluk | |
| 6,629,588 | B2 | * | 10/2003 | Nykoluk et al. | 190/102 |
| D492,110 | S | * | 6/2004 | Van Himbeeck et al. | D3/279 |
| 7,143,878 | B2 | | 12/2006 | Selvi | |
| 2002/0130004 | A1 | | 9/2002 | Lin | |
| 2002/0185350 | A1 | | 12/2002 | Chang et al. | |
| 2003/0000784 | A1 | | 1/2003 | Hsu | |
| 2003/0155268 | A1 | | 8/2003 | Wang | |
| 2004/0031654 | A1 | | 2/2004 | Chang | |
| 2004/0035661 | A1 | | 2/2004 | Krulik et al. | |
| 2004/0101669 | A1 | * | 5/2004 | Chang | 428/212 |
| 2004/0231941 | A1 | * | 11/2004 | Van Hoye et al. | 190/124 |
| 2005/0056511 | A1 | * | 3/2005 | Hsieh | 190/125 |
| 2005/0067244 | A1 | | 3/2005 | Smith et al. | |

FOREIGN PATENT DOCUMENTS

| | | | |
|---|---|---|---|
| CN | 2347646 | | 11/1999 |
| CN | 2511175 | | 7/2001 |
| CN | 2566676 | | 8/2003 |
| DE | 20301888 | U1 | 5/2003 |
| EP | 1 228 713 | A2 | 8/2002 |
| EP | 1 228 713 | A3 | 3/2003 |
| FR | 2318602 | | 2/1977 |
| GB | 1 288 078 | | 9/1972 |
| GB | 2 173 393 | A | 10/1986 |
| GB | 2 201 335 | A | 9/1988 |
| GB | 2 248 384 | A | 8/1992 |
| GB | 2338 177 | A | 12/1999 |
| GB | 2 366 512 | A | 3/2002 |
| GB | 2 372 981 | A | 11/2002 |
| WO | WO 93/05943 | | 4/1993 |

* cited by examiner

ARTICLE OF LUGGAGE

CROSS-REFERENCE TO RELATED APPLICATIONS

This application is a U.S. national counterpart application under 35 U.S.C. 371 of international application Ser. No. PCT/GB2004/004425 filed Oct. 20, 2004, which claims priority to British applications Ser. Nos. 0324487.8 and 0415404.3 filed Oct. 21, 2003, and Jul. 9, 2004, respectively.

This invention relates to the construction of luggage such as suitcases and/or trolley cases for use by travellers.

Such cases, can conveniently be considered as comprising two major types, the first the so-called soft case and the second the so-called hard or non-soft case.

Many constructions of such cases for use by travellers are known. These known constructions of both 'hard' and 'soft'. cases are of varied form and not infrequently include carrying handle arrangements and at least a pair of wheels/rolls for facilitating the movement of the case by a user.

In addition, it is also known to provide cases incorporating a towing handle structure which is usually moveable between a user case towing position and a retracted stowage position.

The above mentioned 'hard' cases are regarded as being hard in the sense that the walls, top and bottom cannot be pierced by a blade or needle as is possible with soft case constructions.

Conventionally the so-called 'hard' cases incorporate a metal or plastics framework extending all round the internal perimeter of the case in such position as to provide structural strength to the case. Such frameworks can involve internal tongue and groove arrangements.

The 'soft' case conventionally incorporates an internal framework of metal or appropriate plastics material extending around the total periphery of the associated case top and base/bottom sections which provide the means whereby the visual appearance of the case is obtained and also serves to support a soft outer covering. In addition, plywood or plastics material such as P. E. board re-enforcement at the case top, base, and corner sections may be incorporated.

Whilst the provision of an internal framework is a standard/common feature of 'soft' case construction it is known to avoid using the framework extending around the internal periphery of a 'soft' case and to provide instead internal reinforcement arrangements i.e., P. E. side panels together with P. E. material base and back panels. These particular cases have become known as 'Box' construction or side panel cases.

It is an object of the invention to eliminate such frames and the need for such internal reinforcement. arrangements Broadly, in accordance with a first aspect of the invention there is provided an article of luggage characterised by a 'soft' case construction including lid and base forming sections of such construction as to be shape wise self supporting in the absence of a perimeter frame and/or side, base or back panels whereby the form of the case is established and maintained by the moulded lid and base sections.

In accordance with a second aspect of the invention there is provided an article of luggage characterised by a 'soft' case construction including lid and base forming sections of such moulded form as to be shape wise self supporting in the absence of a perimeter frame and/or side, base or back panels whereby the form of the case is established and maintained by the moulded lid and base sections.

Preferably the article of luggage does not rely upon the use of corner supports and/or additional side panel forming reinforcements.

Conveniently the article of luggage incorporates a carrying handle together with a towing handle and associated handling support wheel assemblies When a single pair of wheel assemblies are provided they are provided on the base section of the case.

Preferably, when two pairs of wheel assemblies are provided one pair of wheel assemblies is provided at one end of the base section and a second pair of wheel assemblies at the corresponding end of the lid section, Preferably the pairs of wheel assemblies are so located on their respective sections as to lie at the corners of a rectangle.

Preferably the article of luggage includes lid and base sections that are moulded from a foamed plastics material such as those known as EVA or expanded PVC.

In a preferred construction the lid and base sections are externally covered by fabric material shaped to conform closely to the external form of the lid and base sections.

In accordance with a further aspect of the invention there is provided a method of producing an article of luggage characterised by a 'soft' case construction characterised by the steps of moulding from a material exhibiting 'soft' case characteristics lid forming and base forming sections of such construction as to be shape wise self supporting in the absence of a perimeter frame and/or side, base or back panels whereby the form of the case is established and maintained by the moulded lid and base sections.

According to a further aspect of the invention a case construction incorporates a moulded lid forming section, a moulded base forming section with both said sections being moulded from a foamed plastics material such that the sections incorporate corrugations/recesses at corner positions as to enhance rigidity of the mouldings.

Preferably the two moulded sections are connected together by a zip fastener arrangement adapted for enabling the hinging of the two sections with respect to each other and to provide opening an closing facility to the case.

In a preferred construction in which a capability of volume expansion of the case is desired the zip fastener arrangement incorporates two separately operable zip fasteners, there being a gusset provided between the zipping portions of one of the fasteners the arrangement being such that the volume of the case can be increased by appropriate operation of said one of the fasteners.

If a multiple volume expansion facility is desired the zip fastener arrangement incorporates additional zip fasteners each having associated therewith an expansion gusset whereby operation of a zip fastener associated with a gusset enables appropriate volume expansion.

It will be understood that if expansion of volume is not desired the Zip fastener arrangement would only need a single Zip fastener associated with the opening and closing of the case.

For a better understanding of the invention and to show how to carry the same into effect reference will now be made to the accompanying drawings in which:—

Figure 1:
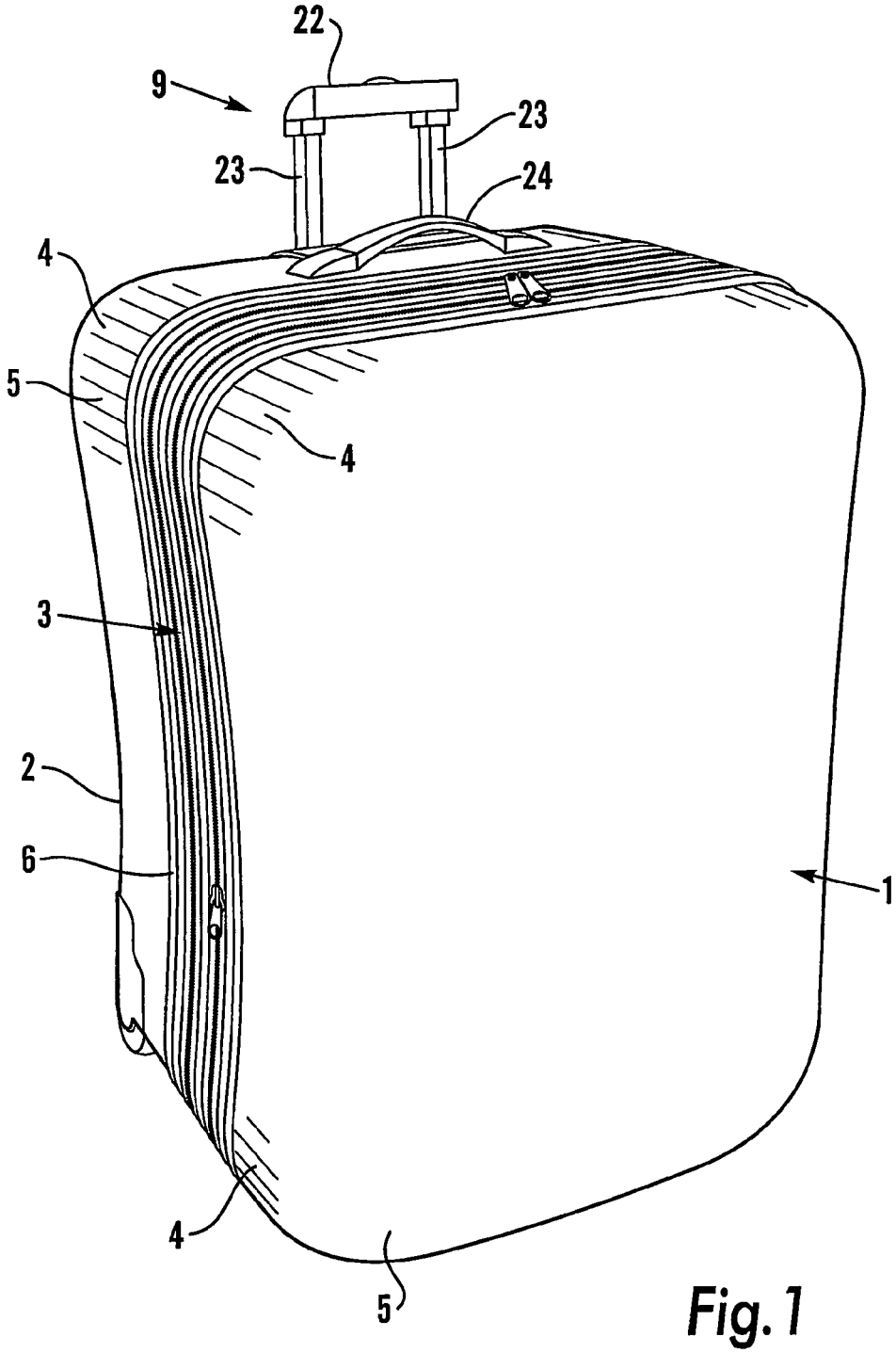
FIG. 1 illustrates a general oblique front view of a case incorporating the concepts of the invention.
Figure 2:
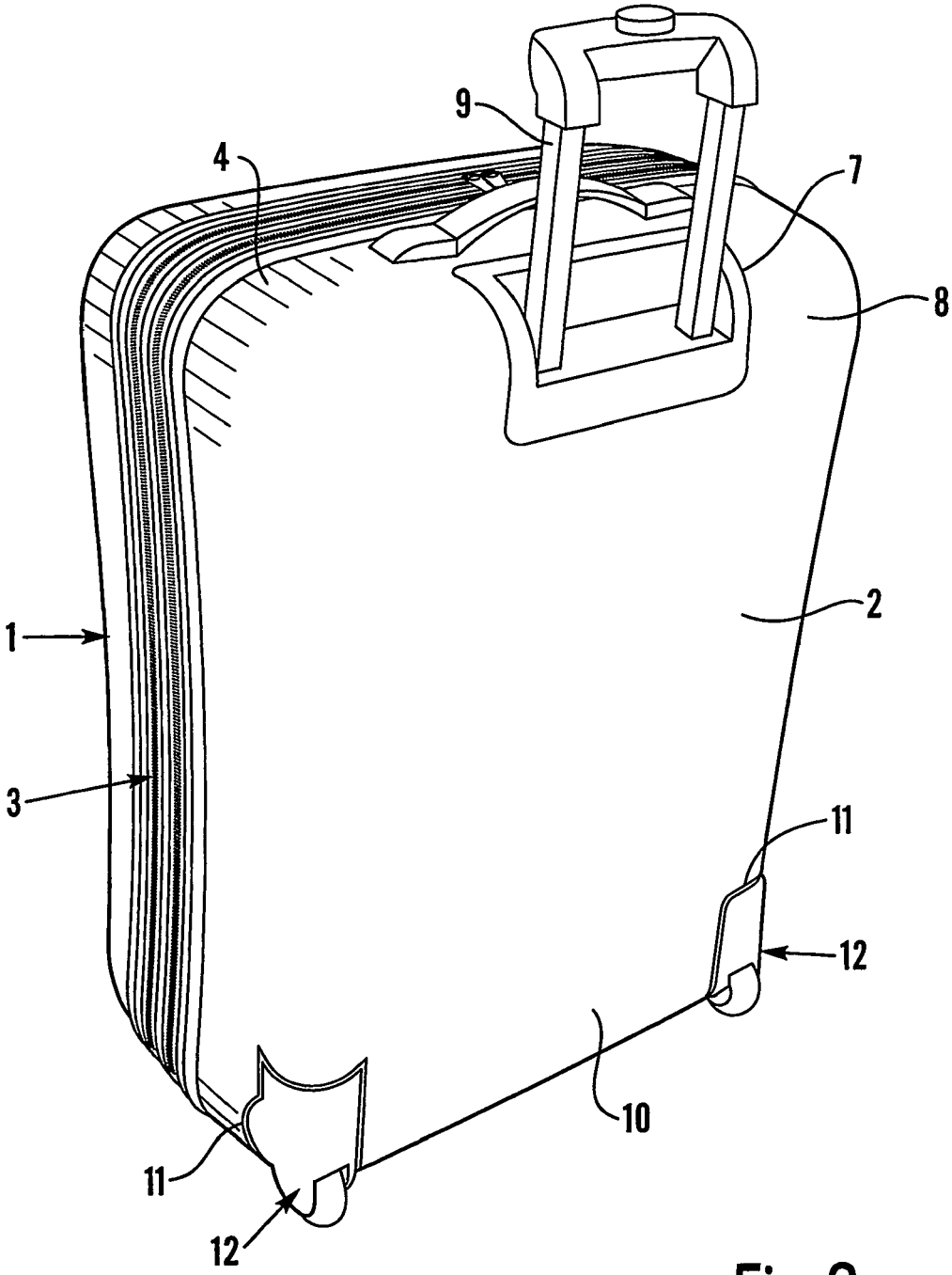
FIG. 2 illustrates a general oblique rear view of a case incorporating the concepts of the invention.

Referring now to the drawings and more particularly to FIGS. 1 and 2 the case shown in FIG. 1 can be regarded as incorporating lid and base sections 1, 2 respectively of a tray like form moulded from a foamed plastics material such as that known as EVA. The sections 1 and 2 are externally covered by a fabric material shaped to conform closely to the external form of the lid and base sections.

The two sections 1 and 2 are secured one to the other by a a Zip fastener configuration 3 that provides a conventional Zip fastener type closure facility to the case and if it should be needed the facility of enabling increase in the storage volume of the case 1

To provide enhanced physical shape retaining physical strength to the surfaces of the moulded lid and base sections 1 and 2 and to avoid the formation of material wrinkles during the moulding operation corrugations/recesses 4 are provided at the corner regions 5 of the rims 6 of the associated section.

An opening 7 is provided at one end 8 of the base section 2 for receiving a towing handle arrangement 9 (FIG. 2). In addition each of the corner regions 5 of the other end 10 of the base section 2 is provided with a profiled indentation 11 defining the location of suitcase handling wheel assemblies 12.

Figures 3, 3A:
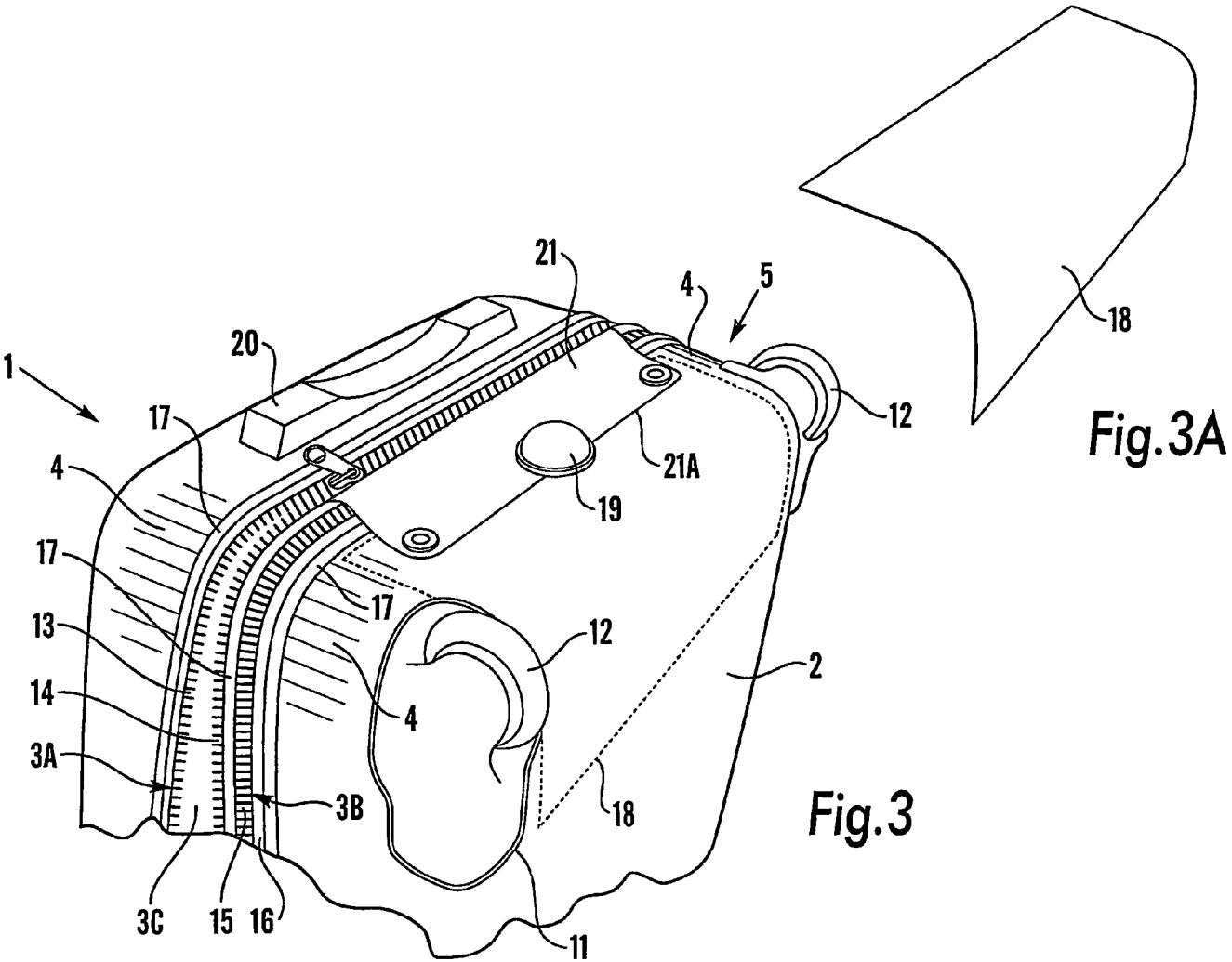
FIG. 3 is a schematic fragmentary view illustrating details of the structure of the one end of a case illustrated in FIGS. 1 and 2.
FIG. 3A illustrates schematically a detail of the luggage of FIG. 3.

Referring now to FIGS. 3 and 3A these Figures very schematically illustrates in more detail the Zip fastener arrangement 3 and additionally more detail relating to the structure of the suitcase at said other end 10 of the base and lid sections 1 and 2.

As shown in the Figures the Zip fastener arrangement 3 is a double arrangement of Zip fasteners including a first Zip fastener 3A associated with the provision of a gusset 3C for enabling volume expandability for the case and including a first zipping portion 13 connected with the lid section 1 and extending substantially around the total perimeter of the lid section 1 and a second zipping portion 14 that is effectively connected to a first zipping portion 15 of a second Zip fastener 3B the latter having a second zipping portion 16 connected with and extending substantially around the total perimeter of the base section 2 between the hinging region (to be discussed herein after) of the lid and base sections 1 and 2. The effective length of Zip fasteners 3A and 3B is such as to allow total closure of the Zip fastener arrangement 3 for both closing the suitcase selective choice of the storage volume of the case.

If a multiple volume expansion facility is desired the zip fastener arrangement 3 incorporates additional zip fasteners (not shown in the Figures) each having associated therewith an expansion gusset whereby operation of a zip fastener associated with a gusset enables appropriate volume expansion.

If volume expansion is not required a single Zip fastener would be provided merely to relate to the opening and closing of the case.

Piping 17 is provided in the join between the zip fastener portion 13 and the lid section 1, between the zipping portion 14 of fastener 3A and the zipping portion 15 of fastener 3B and between the zipping portion 16 and the base section 2. If desired one or more runs of the piping can be omitted.

These runs of piping 17 are such as to provide stiffness to the operational runs of the associated Zip fasteners 3A and 3B thus to the composite Zip fastener arrangement 3. If desired this piping 17 an be stiffened by an internally provided wire (not shown) extending lengthways of the piping.

It will be appreciated that not only does the piping 17 if included affords stiffness to the Zip arrangement 3 but additionally to the overall stiffness of the facing edge regions of the case lid and bottom sections 1 and 2.

As will be seen from the FIG. 3 the gusset 3C is provided between the zipping portions 14 and 15 of the Zip fasteners 3A and 3B thereby enabling expansion of the storage volume of the suitcase in relation to the free width of the gusset between said zip portions 13 and 14.

It will be understood that the fastener 3A extends around the total length of the periphery of the case lid section with the portion 13 of the fastener is connected there around, with one edge of the gusset being similarly connected to the lid section internally of the zip portion 13. the other edge portion of the gusset is connected with the other zip portion 14 of the zip fastener 3A. With this arrangement when the portions 13 and 14 are in the zip closed setting thereof the gusset is hidden behind the closed Zip with the associated zip operating element located at one end of the zip. In order to enable the lid section 1 fully to move away from the base section 2 to the full available width of the gusset the other end (not shown) of the Zip fastener 3A is attached to the material of the gusset at a point inwardly the said one end whereby this other end of the Zip fastener 3A when is closed is located between the gusset and the and a short length of the Zip portions 13 and 14.

The FIG. 3 generally illustrates the provision of the wheel assemblies 12. In practice, in order to mount the wheel assemblies each of the profiled indentations 11 is appropriately partially removed to accept and mount the wheel assemblies 12. In other words the wheel assemblies 12 are fitted into openings thus provided in the corners 5 of the case at the locations defined by the above mentioned indentations 11. Furthermore, if desired, a bracing strip 18 schematically illustrated in FIG. 3A and by dashed lines in FIG. 3 may be provided between the two wheel assemblies to increase riveting strength when the assemblies are riveted in position.

In order to facilitate the stability of the suitcase when resting upright on the ground the suitcase is provided with a centrally located foot 19 on the base section 1 as shown and a further centrally located strip-like foot 20 on the lid section as shown. As will be appreciated the arrangement of the feet 19 and 20 prevents contact of the body of the case with the ground thereby assisting in protecting the appearance of the suitcase when in use.

In the embodiment of the case illustrated in the Figures a hinge facility is located at the end 10 of the case. This hinging facility can comprise a strip 21 of suitable plastics/fabric material. One end 21A of the strip 21 is located between the foot 19 and the material of the base section 1 whilst the other end of the strip (not shown) is connected internally to the lid section. It will be noted the strip 21 bridges the Zip fastener 3B and passes under the Zip fastener 3A. If desired the overall length of the hinge strip 21 can at least partially accommodate the volume expansion facility. If desired other modes of hinging could be adopted.

As has been mentioned the case incorporates a towing handle assembly 9. The assembly as shown in FIG. 1 includes a handle 22 located at the upper end of two side by side parallel bars 23 that telescope into a pair of parallel tubes (not shown) located in the interior of the base section 2.

As is conventional the case is provided with a carrying handle 24 that in the embodiment of the case illustrated is provided at the end 8 of the base section 2.

Figure 4A:
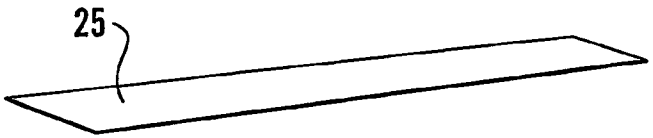
FIG. 4A shows a bracing strip 25.
Figure 4:
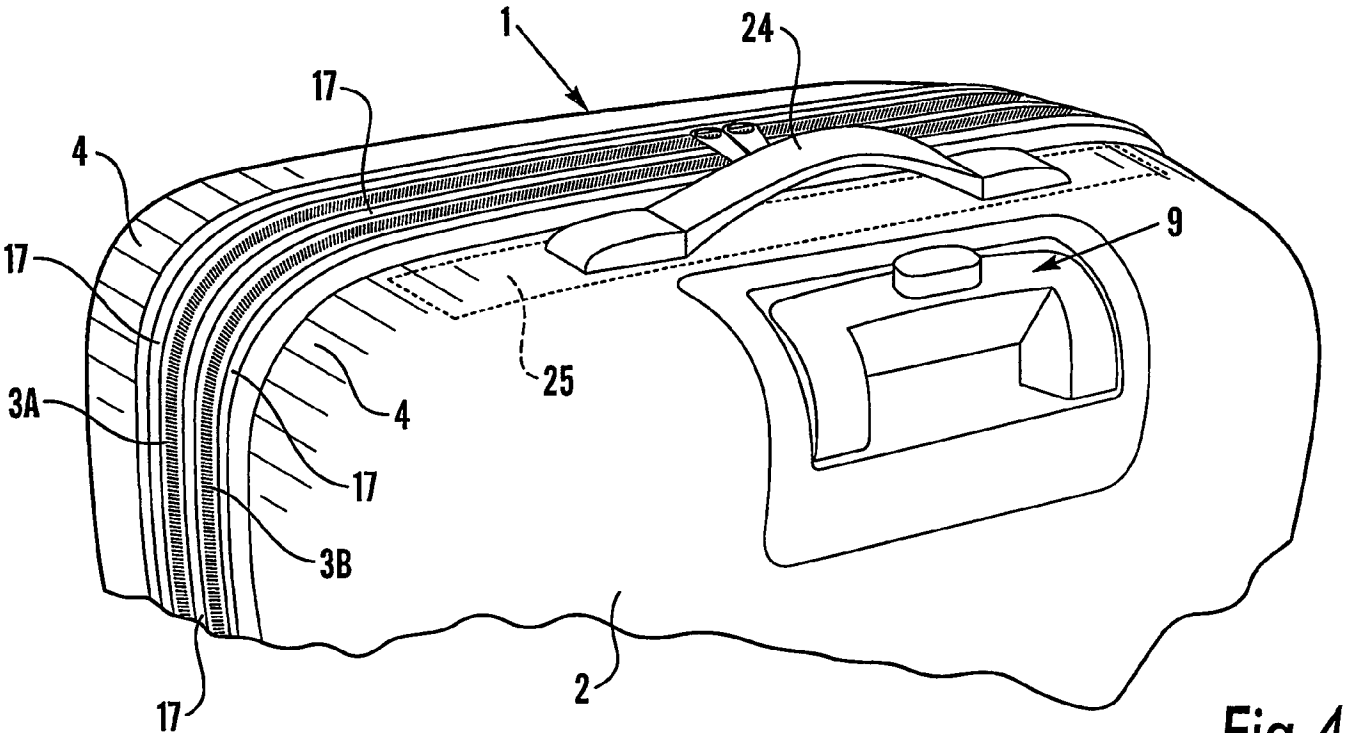
FIG. 4 is a schematic fragmentary view illustrating details of the structure of the other end of a case illustrated in FIGS. 1 and 2.

The handle 24 can be mounted to the base section 2 by any convenient means such as by means of nuts and bolts or rivets (not shown) Furthermore, if desired a bracing strip 25 schematically illustrated in FIG. 4A and by dashed lines in FIG. 3 may be provided in the interior of the base section to provide additional riveting strength in the vicinity of the handle 23

The interior of the suitcase is provided with a lining that covers in the structural features located in the interior of the lid and bottom section 1 and 2.

Figure 5:
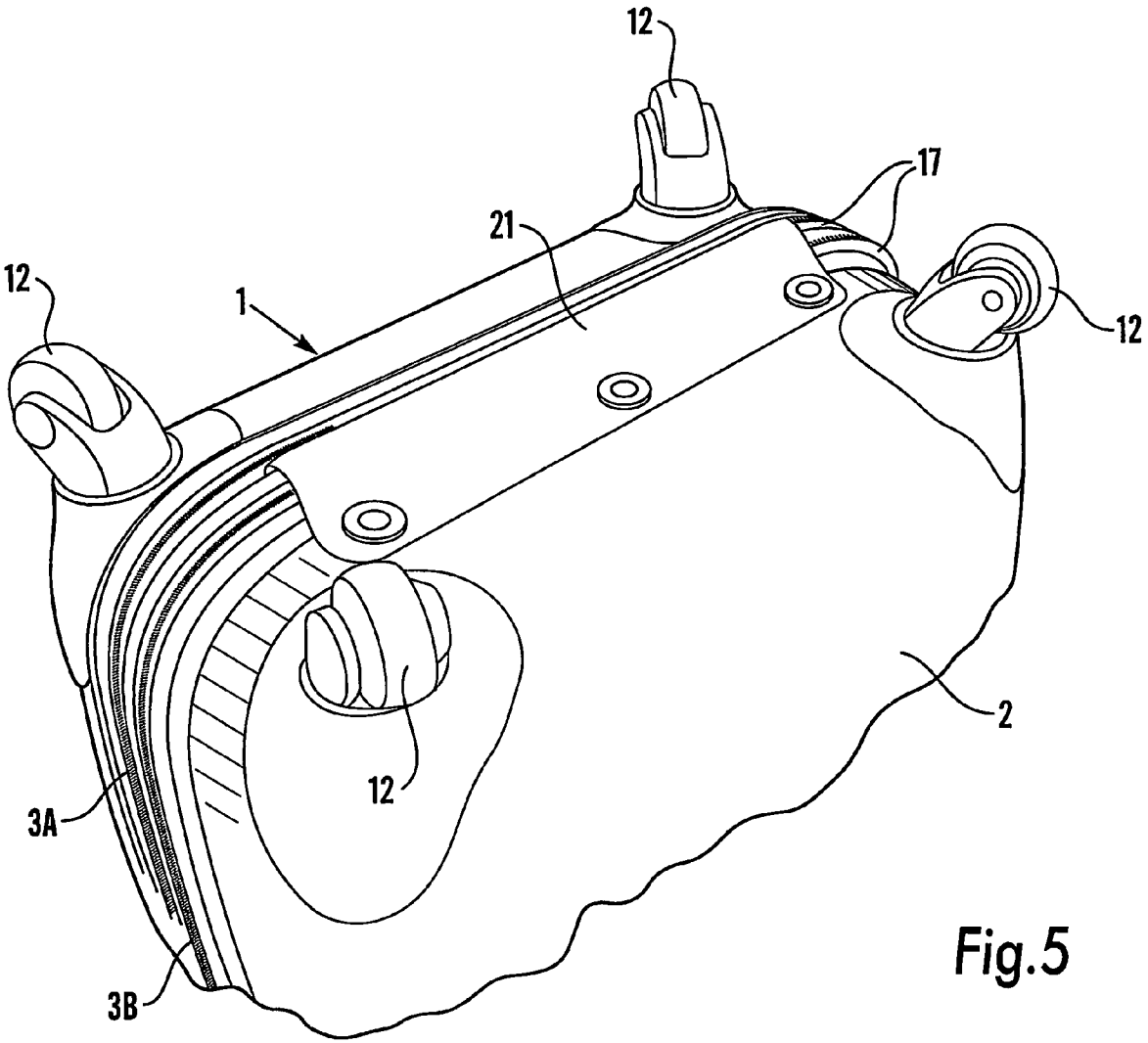
FIG. 5 illustrates a bottom view of a case incorporating two pairs of wheel assemblies.

Referring now to FIG. 5 this Figure illustrates a modified structure of the case of the preceding Figures in which the case is provided with two pairs of wheel assemblies 12 rather than the single pair illustrated in the previous Figures. In this modification one pair of wheel assemblies is provided upon the lid section 1 and a further pair of wheel assemblies is provided upon the base section 2.

With a view to accommodating the mounting of the wheel assemblies to the lid section the associated corners 5 of the case can be formed in the manner previously discussed in relation to the assemblies 12 of the base section shown in FIG. 3.

It will be appreciated that the lid section would, if found necessary be suitably shape wise modified so as to enable the mounting of wheel assemblies 12 to the lid section The relative dimensioning of the wheel assemblies 12 and the base and lid sections 1 and 2 would be such that the case can freely stand upright when resting upon all four wheel assemblies. As will be noted from FIG. 5 the wheel assemblies 12 are are effectively located at the corners of a rectangle.

The wheels of the assemblies 12 are castorable i.e., able to swivel through 360 degrees of arc and are located as mentioned at the corners of a rectangle.

It will be appreciated that by providing the case with four wheel assemblies it is not necessary to include the case support feet 19 or 20.

In practice, the case 1 can be readily manually handled by a user in a variety of modes; including a conventional two wheel pulling mode, a two wheel side pulling mode for negotiating narrow aisles and other narrow spaces i.e., between persons, a two wheel side pushing mode for negotiating narrow aisles and other narrow spaces, a four wheel side pulling mode or a four wheel forward pushing mode.

The invention claimed is:

1. A soft suitcase, said soft suitcase comprising:

a lid section and a base section each comprising a foamed plastic material, wherein said lid section and said base section are moulded as one-piece tray-like forms and both are shape-wise maintaining such that said soft suitcase has no internal or external perimeter framing around an entire periphery of said lid section or of said base section, and wherein each of sections has no reinforcing side, base and back panels so that said soft suitcase is not of a box construction, and wherein said lid section and said base section being hinged together;

a first zipper fastener that provides an opening and closing facility between said lid section and said base section;

a second zipper fastener that provides a selective expansion of a storage volume of said soft suitcase; and at least one pair of wheels provided at one end of said base section wherein said at least one pair of wheels comprises a first pair of wheels and further comprises a second pair of wheels provided at an end of the lid forming section corresponding to the end of the base forming section at which said first pair of wheels is located.

2. The soft suitcase as claimed in claim 1, wherein said first and second pair of wheels are so located on the respective base forming section and lid forming section as to lie at corners of a rectangle.

3. The soft suitcase as claimed in claim 1, wherein each wheel of said at least one pair of wheels are included as part of a respective wheel assembly of a pair of wheel assemblies and wherein the base forming section has a first pair of indentations to define mounting locations for the first pair of wheel assemblies and wherein the lid forming section has a second pair of indentations to define mounting locations for the second pair of wheel assemblies.

* * * * *